United States Patent [19]

Okazaki et al.

[11] Patent Number: 4,560,461

[45] Date of Patent: Dec. 24, 1985

[54] ELECTROLYTIC CELL FOR USE IN ELECTROLYSIS OF AQUEOUS ALKALI METAL CHLORIDE SOLUTIONS

[75] Inventors: Toshimasa Okazaki, Okazaki; Shuta Nakagawa, Nagoya, both of Japan

[73] Assignee: Toagosei Chemical Industry Co., Ltd., Tokyo, Japan

[21] Appl. No.: 366,582

[22] Filed: Apr. 8, 1982

[51] Int. Cl.[4] ..... C25B 9/00; C25B 11/03; C25B 13/08

[52] U.S. Cl. ..... 204/252; 204/283; 204/296; 204/290 R

[58] Field of Search ..... 204/252, 253, 258, 282, 204/284, 286, 98, 128, 283, 290 R, 296

[56] References Cited

U.S. PATENT DOCUMENTS

| | | | |
|---|---|---|---|
| 3,407,096 | 10/1968 | Landi | 136/86 |
| 3,674,676 | 7/1972 | Fogelman | 204/286 |
| 3,871,988 | 3/1975 | Harke et al. | 204/284 |
| 4,028,214 | 6/1977 | Ford et al. | 204/286 |
| 4,191,618 | 3/1980 | Cooker et al. | 204/98 |
| 4,224,130 | 9/1980 | Moreno et al. | 204/266 |
| 4,226,685 | 10/1980 | Portal et al. | 204/105 R |
| 4,255,240 | 3/1981 | Molnar et al. | 204/98 |
| 4,256,554 | 3/1981 | Bjorkman | 204/128 |
| 4,268,372 | 5/1981 | Iizima et al. | 204/252 |
| 4,332,661 | 6/1982 | Ford et al. | 204/253 |
| 4,345,986 | 8/1982 | Korach | 204/283 X |
| 4,439,297 | 3/1984 | Kircher et al. | 204/283 X |
| 4,457,822 | 7/1984 | Asano et al. | 204/290 R X |

FOREIGN PATENT DOCUMENTS 56-38486 4/1981 Japan .

OTHER PUBLICATIONS

Talivalids Berzins, Electrochemical Characterization of Nafion Perfluorosulfonic Acid Membranes in Chlor-Alkali Cells.

*Primary Examiner*—Donald R. Valentine
*Attorney, Agent, or Firm*—Cooper, Dunham, Clark, Griffin & Moran

[57] ABSTRACT

In electrolytic cell for use in electrolysis of aqueous alkali metal chloride solutions, which comprises one or more vertical expandable anodes, one or more vertical cathodes and one or more cation-exchange membranes each located between a pair of the opposite anode and cathode plates; an improvement is now provided, which is lying in the newly devised cathode structure comprising a vertical cathode, a flexible and foraminate metal mesh of low hydrogen-overvoltage removably mounted on one side of said cathode, a hydraulically permeable and hydrogen gas bubbles-impenetrable microporous film removably mounted on said metal mesh, and a cation-exchange membrane removably mounted on said microporous film, in such way that the expandable anode as located adjacent to said cation-exchange membrane is able to exert a resilient force to push the cation-exchange membrane against the microporous film, the metal mesh and the cathode plate; and to bring the latter elements into close contact with each other. This cathode structure effectively prevents the cation-exchange membrane from being attached with and covered with the developed hydrogen gas bubbles, resulting in prevention of unduly increased cell voltage in operation of the cell.

8 Claims, 2 Drawing Figures

ELECTROLYTIC CELL FOR USE IN ELECTROLYSIS OF AQUEOUS ALKALI METAL CHLORIDE SOLUTIONS

SUMMARY OF THE INVENTION

This invention relates to an electrolytic cell for use in the production of chlorine and an alkali metal hydroxide by electrolysis of aqueous alkali metal chloride solution, and more particularly this invention relates to an electrolytic cell of vertical type containing the cation-exchange membrane located between the anode and cathode which is intended to be used in electrolysis of aqueous alkali metal chloride solutions.

DESCRIPTION OF PRIOR ART

The electrolytic methods using an electrolytic cell provided with the cation-exchange membrane have been carried out commercially in recent years.

In the electrolysis of an alkali metal chloride, it is usual that the cost of electric power consumed during the electrolytic process amounts to a higher proportion of the total cost for the electrolytic production of chlorine and alkali metal hydroxide. Owing to this, every effort has been made to reduce the electric voltage required for operation of the electrolytic process as low as possible, and to improve the electric current efficiency as much as possible.

We, the present inventors, have extensively researched in an attempt to provide new electrolytic process by which the required electrolytic cell voltage can be reduced, and then we have paid attention to the article of Mr. Berzins titled "Electrochemical Characterization of Nafion Perfluorosulfonic acid Membranes in Chlor-alkali Cells" presented at the Meeting of The Electrochemical Society held at Atlanta, Ga., U.S.A. in October of 1977. As a result of our study, we have now found that the required cell voltage can be increased adversely by about 0.5 voltage due to the fact that the Nafion membrane becomes covered with a layer of hydrogen gas bubbles developed during the electrolytic process, and that the required cell voltage can be reduced effectively by preventing the gas bubbles from attaching onto and covering the cation-exchange membrane in the cell during operation. On the basis of these findings, we have made further researches in an attempt to provide a new, improved electrolytic cell of vertical type containing the cation-exchange membrane located between the anode and cathode. Now, we have provided a new electrolytic cell according to this invention.

DETAILED DESCRIPTION OF INVENTION

According to this invention, there is provided an electrolytic cell for use in electrolysis of aqueous alkali metal chloride solutions and comprising one or more expandable anodes, one or more cathodes and one or more cation-exchange membranes each located between the opposite anode and cathode surfaces, characterized by a flexible and foraminate metal mesh having low hydrogen-overvoltage is removably mounted on the anode-opposing surface of the cathode, a microporous film which is essentially hydraulically permeable but through which hydrogen gas bubbles are essentially impenetrable is removably mounted on said metal mesh, and a cation-exchange membrane is removably mounted on said microporous film, and that the expandable anode is so positioned adjacent to the cation-exchange membrane that the expandable anode is able to exert the force to bring the cation-exchange membrane, the microporous film, the metal mesh and the cathode surface into close contact with each other to form a unitary cathode structure.

In the cell of this invention, one or more anodes and one or more cathodes are located vertically and parallel to each other, and there are provided between a pair of the opposite anode and cathode the flexible and foraminate (ie., containing many holes) metal mesh, the hydraulically permeable and hydrogen gas bubbles-impenetrable microporous film and the cation-exchange membrane each of which are mounted vertically and removably on the anode-opposing side of the cathode in such manner that they are superposed on the anode-opposing surface of the cathode successively in the sequence as just mentioned. By means of the expandable anode, the metal mesh, the microporous film and the cation-exchange membrane are pressed against the cathode surface and brought into close contact with each other to form a unitary cathode structure. In the cell of this invention, there may be interposed a spacer between a pair of the anode and the cation-exchange membrane which is facing to said anode, if required.

According to a second aspect of this invention, therefore, there is provided a cathode structure for use in an electrolytic cell of vertical type for electrolysis of aqueous alkali metal chloride solutions, comprising a vertical cathode, a flexible and foraminate metal mesh of low hydrogen-overvoltage vertically and removably mounted on said cathode, an essentially hydraulically permeable and hydrogen gas bubbles-impenetrable microporous film vertically and removably mounted on said metal mesh, and a cation-exchange membrane vertically and removably mounted on said microporous film, in such a way that the cathode, the metal mesh, the microporous film and the cation-exchange membrane can be pressed against each other and brought into close contact with each other by means of an expandable anode.

In the prior art electrolytic cell in which a cation-exchange membrane is interposed between a pair of the opposite anode and cathode, the anode and the cathode are usually arranged with a gap of several milimeters between them, when the cation-exchange membrane is usually attached to the anode. In contrast, according to this invention, the cation-exchange membrane is attached to the cathode via the foraminate metal mesh and the microporous film as stated above.

The cation-exchange membrane used in this invention may be anyone known in this technical field but may preferably be a fluoro-polymer membrane which is resistant to the corrosion by the catholyte and anolyte. In the cation-exchange membrane preferably made of a fluoropolymer, for example, polytetrafluoroethylene, the cation-exchange groups present therein may be either a strongly acidic group such as sulfonic acid group or a weakly acidic group such as carboxylic group. It is also possible to use a cation-exchange membrane made of a fluoro-polymer containing both the strongly acidic group and the weakly acidic group as the cation-exchange functions. A suitable example of the cation-exchange membrane is a film of polytetrafluoroethylene bearing sulfonic acid group as the cation-exchange groups and may be available, for example, under a tradename "Nafion" membrane (a product of Du Pont Inc., U.S.A.).

In the cell of this invention, the cathode plate may be made of any suitable material known in the art and may be made of iron, nickel or an alloy containing iron and nickel. The cathode plate may be of a commonly used shape and preferably may be of foraminate construction, for example, in the form of expanded metal, metal mesh or gauge, multi-perforated plate, slotted plate or louvered boards to facilitate the release of gases.

The foraminate metal mesh having low hydrogen-overvoltage which is superposed on the cathode face should be flexible and preferably may be deformable to any optional shape. The metal mesh may be in the form of net or gauge, metallic wool, metallic woven cloth or the like. The metal mesh should have a foraminate structure, that is, contains a number of small holes. When the metal mesh is in the form of a metal net, the size of the meshes may be in the order of 600 meshes to 10 meshes (Taylor). The foraminate metal mesh may be made of iron, nickel or an alloy of nickel-iron or a stainless steel and preferably may be made of nickel or a nickel base alloy.

The foraminate metal mesh is necessary to maintain a low hydrogen-overvoltage, and it is possible that the metal mesh has been pre-treated so that the faces of the metal mesh exhibit a low hydrogen-overvoltage. For instance, the pre-treatment process for imparting the property of low hydrogen-overvoltage to the foraminate metal mesh may comprise either applying a coat of aluminum, zinc or the like to a foraminate metal mesh made of a metal surstrate such as iron or nickel and then subjecting the coated material to a leaching treatment, or applying thereon a coat comprising one or more platinium group metals such as platinium, rhodium, iridium, ruthenium, osmium or palladium, or an oxide of one or more of these metals, or a coat comprising nickel or cobalt or a nickel base alloy or a cobalt base alloy or an oxide or a carbide of these metals. The coating for this purpose may comprise any other suitable material known in the art for the intended purpose. In general, the foraminate metal mesh can operate well even when it is superposed simply on the cathode plate without being mechanically connected to the cathode plate. To facilitate the assembling of the cathode structure, however, it is possible to mechanically fix some portions of the foraminate metal mesh to the cathode plate, for example, by means of fine wire or the like. If the metal mesh has deteriorated in the electrolytic process so that it produces an unduly increased hydrogen-overvoltage, the deteriorated metal mesh can easily be replaced by a fresh one. In use, the foraminate metal mesh can be connected electrically to the cathode plate and operate well, as long as the metal mesh is located in close contact with the cathode plate by means of the expandable anode in the expandable condition.

The microporous film which is superposed on the foraminate metal mesh should be permeable to liquids and ions but should essentially be hydrogen gas bubbles-impenetrable i.e., should essentially not permit the passage therethrough of the hydrogen gas bubbles developed during the electrolytic process. It is preferred that the micropores present in the microporous film employed should be of a size in the order of 1 micron to 100 microns in diameter, and that the microporous film should be 0.05 mm to 2 mm in thickness and should have an electric resistance of not more than 10 ohms-$cm^2$. The microporous film may preferably be made of a flexible and soft material, and it is not preferred that the microporous film is made from a hard material such as metallic sheet. The available material for forming the microporous film for the above purpose includes polypropylene, polytetrafluoroethylene (available under a tradename "Teflon"), asbestos, polyvinyl chloride and the like. The microporous film may also be a sheet which is prepared by sintering a mixture of finely divided graphite and an aqueous polytetrafluoroethylene dispersion or a finely divided solid polytetrafluoroethylene powder in the form of a sheet. The microporous film may take various forms in its construction and may be, for example, in the form of gauge, net, woven cloth, semi-sintered non-woven fabric or ordinary sheet, or the like.

According to this invention, the microporous film is provided to achieve the purpose of preventing the bubbles of hydrogen gas from attaching onto and covering the cation-exchange membrane in the electrolytic cell during operation. Any film may be used as the microporous film, as long as it is suitable for the intended purpose and able to meet the above-mentioned requirements. The microporous film used should preferably have an electric resistance of up to 10 ohms-$cm^2$ if economic operation of the cell is to be achieved.

During the time when operation of an electrolytic cell is being stopped, the anion $ClO^-$ produced sometimes would transfer from the anolyte by diffusion to pass through the cation-exchange membrane and reach the foraminate metal mesh of low hydrogen-overvoltage as well as the cathode plate, if the microporous film in accordance with this invention is not located in its position, so that severe corrosion could take place where the face of the metal mesh contacts the cation-exchange membrane, resulting in a risk of the corroded material contaminating the surface of the cation-exchange membrane which is facing toward the cathode. This risk of contamination of the cation-exchange membrane is prevented by the provision of the microporous film according to this invention, and hence the microporous film displays its second part in preventing the possible contamination of the cation-exchange membrane. Even when the microporous film is provided between the cation-exchange membrane and the foraminate metal mesh in accordance with this invention, it happens that corrosion can take place to an extent, and therefore it is preferred that the anion $ClO^-$ should be removed out of the cell as soon as possible, by replacing the anolyte by a volume of aqueous alkali metal chloride solution or water, when operation of the electrolytic process is being stopped. Besides, it is useful to effect the passage of anti-corrosive electric current through the cell in order to prevent the risk of corrosion at the cathode plate and the other elements of the cell. When the anti-corrosive electric current is passed through the cell during stoppage of operation of the cell, the anion $ClO^-$ can be reduced to the chloride anion $Cl^-$. The required current density of the anticorrosive electric current for the above-mentioned purpose varies in a range of 10 to 100 mA/$dm^2$, depending on the nature of the cation-exchange membrane employed.

In the cell of this invention, the cathode plate, the foraminate metal mesh, the microporous film and the cation-exchange membrane are pressed against each other and brought into close contact with each other by means of the expandable anode, as stated hereinbefore. Various types of expandable anodes are already known, for example, as described in U.S. Pat. No. 3,674,676 and the corresponding Japanese patent publication No. 35,031/75. An expandable anode available in this invention is of such type which one side face of the anode installed in the cell is able to expand toward the cathode side, for example, by means of a spring device or the like, which can project toward the cathode side. With an electrolytic cell of the vertical type for use in the electrolysis of aqueous alkali metal chloride solutions, the expandable anode to be provided in such cell is presented in its expanded condition and usually has its one side face projected by a few millimeters to ten millimeters toward the cathode side, before the anode compartment is assembled into the cell. Upon assembling the electrolytic cell, however, the expandable anode of this type is contracted or collapsed so as to shorten the projecting part to a predetermined, contracted position and hence to produce a repelling power or resilience which would press the adjacent cation-exchange membrane, the microporous film and the foraminate metal mesh against the cathode plate and brings these parts into close contact with each other, to form a unitary cathode structure. When assembling an electrolytic cell of the asbestos diaphragm type, it is possible to provide an expandable anode of such construction which is expandable by withdrawing a stoppage pin therefrom, to install at first this expandable anode in its contracted condition into the cell and then to withdraw said pin so as to make the anode expanded toward the asbestos diaphragm and the cathode plate. The electrolytic cell used according to this invention is often closed at the upper frame of the cell, and it is not preferred to provide an expandable anode of the above-mentioned construction which is installed in its contracted condition into the cell and then expanded by withdrawal of the stoppage pin, but rather it is preferred to provide an expandable anode of such type which is presented in the expanded condition before being installed into the cell, and to contract this anode upon assembling of the cell, so that the expandable anode in the resiliently contracted condition is located within the cell. For use in this invention, therefore, it is preferred that the expandable anode is of the type that when it is contracted it exerts a resilient force outwardly.

Furthermore, when assembling the electrolytic cell according to this invention, it is preferred that the region of the cation-exchange membrane which is facing toward and located between the opposite cathode plate and anode plate should exist substantially in the same plane as the other region of said cation-exchange membrane which extends far beyond the upper and lower edges of the opposite cathode plate and anode plate, for the following reasons:

(i) the cation-exchange membrane can sometimes be damaged at such region of said membrane or in the vicinity thereof which is supported by being fastened between the upper and lower frames of the cell and sealed by the gasket which fills up the gaps between the cation-exchange membrane and the frames of the cell, even if such a reinforced cation-exchange membrane comprising e.g., a fluoro-polymer film containing reinforcing fibres or filaments of a fluoro-polymer is provided as the cation-exchange membrane in the electrolytic cell of ordinary construction where the cathode plate and the anode plate are arranged with a gap of a few millimeters therebetween; and (ii) according to this invention, the expandable anode in the cell is exerting the force to press the cation-exchange membrane against the adjacent microporous film, the metal mesh and the cathode plate as stated hereinbefore, and it is very likely that a higher strain of breaking or damaging the cation-exchange membrane would be concentrated to the vicinity of the region of the cation-exchange membrane which is being supported by the frames of the cell, than in the electrolytic cell of the prior art. Thus, it is desirable in this invention that the whole cation-exchange membrane exists substantially in the same plane, as described above. The requirement that the whole cation-exchange membrane should exist in the same plane can be met by adjusting appropriately thickness of the cell frames, thickness of the gasket, dimensions of the cell, dimensions of the electrode plates and other factors. Full care should be taken in this respect, and otherwise the cation-exchange membrane could often be damaged.

Embodiments of this invention will now be described by way of example only with reference to the accompanying drawings which illustrate the electrolytic cell according to this invention.

Figure 1:
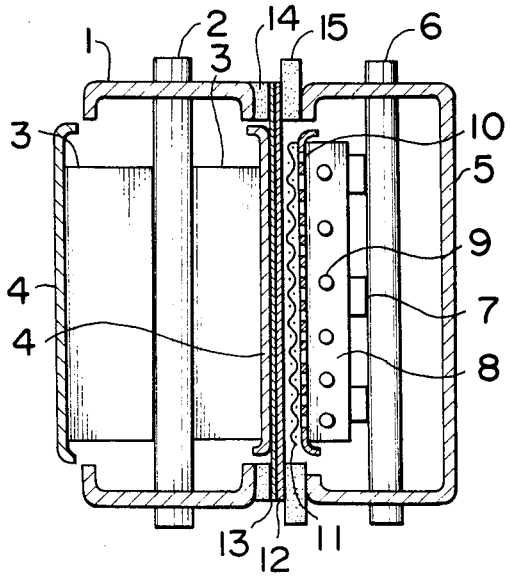
FIG. 1 shows diagrammatically a partial and cross-sectional view of the electrolytic cell provided with vertical, mono-polar electrodes according to this invention.

In FIG. 1, the anode compartment is surrounded by the anode compartment frame 1 which is provided with a lead bar 2 made of a cladded rod comprising a copper metal core coated externally with titanium metal. The frame 1 is electrically connected to the lead bar 2. The lead bar 2 is further connected to a bus bar for supply of direct current. The lead bar 2 is fitted with two ribs 3 welded thereto, which are each further connected to one expandable anode 4. The rib 3 is made of an electrically conductive material and including a spring device which can cause the expandable anode 4 to be expanded. The cathode compartment positioning at the one end of the cell as shown in FIG. 1 is surrounded by the cathode compartment frame 5 to which is fixed a lead bar 6 made of a cladded rod comprising a copper metal core coated externally with a stainless steel of the grade SUS 304 of A.I.S.I. standards. The frame 5 is electrically connected to the lead bar 6. The lead bar 6 has connector bars 7 welded thereto, and a rib 8 is welded to the connector bars 7. The rib 8 is perforated properly to provide holes 9 by which traverse flow of the catholyte is ensured. The rib 8 is fitted with a cathode plate 10 formed from a lath net made of a stainless steel of a grade SUS 304 of A.I.S.I. standards. On the anode-opposing face of the cathode plate 10 is superposed a sheet of a foraminate metal mesh 11 having low hydrogen-overvoltage. A sheet of a microporous film 12 is superposed on the foraminate metal mesh 11. A sheet of the cation-exchange membrane 13 is superposed on the microporous film 12, and both of them are together supported and sealed at their edges between the frames 1 and 5 of the cell. The supported and sealed edges of the microporous film 12 have been pretreated to be water-proof and are clamped by and between the gasket 14 of the anode compartment and the gasket 15 of the cathode compartment. For simplicity, detailed construction of the expandable anode 4 is not shown, but the expandable anode was in the expanded condition and projected much more toward the cathode side than as shown, before the anode compartment was installed into the cell. In the assembled cell, the expandable anode is contracted, and the whole cation-exchange membrane 13 exists in the same plane, that is, the inner region of the cation-exchange membrane which is interposed between the cathode and anode plates is substantially in the same plane as the outer region of the cation-exchange membrane which extends far beyond the edges of the cathodes and anode plates. The gasket 15 of the cathode compartment extends outwardly beyond the frames 1 and 5 of the cell, whereby an electrical short-circuit between the anode side and the cathode side is prevented upon a possible leakage of the anolyte or catholyte out of the cell.

If required, it is feasible to insert a spacer element between the anode 4 and the cation-exchange membrane 13, though such spacer element is not shown in the figures. The provision of such spacer element serves to prevent undue deformation of the cation-exchange membrane which would occur at the areas where the anode occasionally impinges against the cation-exchange membrane. The provision of such spacer element also serves to prevent an electrical short-circuit from taking place between the anode side and the cathode side upon accidental breakage of the cation-exchange membrane.

This invention is now illustrated with reference to the following Examples 1 to 4 wherein Examples 1 and 3 are illustrative of the electrolytic process using the electrolytic cell according to this invention, whereas the Examples 2 and 4 are the comparative ones.

EXAMPLE 1

Figure 2:
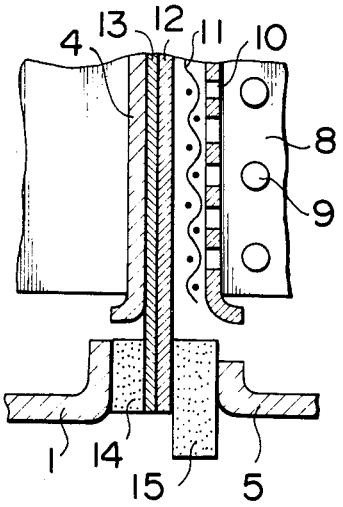
FIG. 2 shows diagrammatically an enlarged view of a portion of FIG. 1.

Experiments for electrolysis of aqueous potassium chloride solution were conducted using a cell fitted with vertical, mono-polar electrodes as shown in FIGS. 1–2. The cation-exchange membrane of the cell showed an effective membrane area of 1 $dm^2$. The experiments were made at a current density of 25 $A/dm^2$. The anode plate comprised a flat sheet of expand metal lath (of the grade: Japanese Industrial Standards A 5505, namely containing rhomb-shaped meshes of 14 mm in horizontal, longer width by 7 mm in vertical, shorter width; the dimensions of the lath strands being 1.5 mm in width by 1.5 mm in thickness) made of titanium metal which had been flattened by passing through a pair of rollers, and of which the lath strands were covered with a 0.3 microns thick coating of an iridium-platinium alloy (Ir : Pt at ratio of 3:7 by weight). The anode plate was arranged in the expandable profile. The cathode plate comprised a flat sheet of expanded metal lath (of the grade: Japanese Industrial Standards A 5505, namely containing rhomb-shaped meshes of 14 mm in horizontal, longer width by 7 mm in vertical, shorter width; the dimensions of the lath strands being 1.5 mm in width by 1.5 mm in thickness) made of a stainless steel of the grade SUS 304 of A.I.S.I. standards which had been flattened by passing through a pair of rollers. The foraminate metal mesh of low hydrogen-overvoltage comprised a sheet of nickel metal mesh of the mesh size of 1.3 mm wide of which the nickel metal filaments of 0.35 mm in diameter had been covered with the 0.6 microns thick coating of ruthenium fired at 400° C. in air. The microporous film comprised a sheet of woven cloth of about 0.2 mm thick, made of very fine polytetrafluoroethylene filaments (available under a tradename "Teflon" from du Pont Inc., U.S.A.) and containing fine meshes of about 350 meshes in size which had been pre-treated with metallic sodium and ethyl alcohol to impart hydrophilic properties to the sheet. This microporous film exhibited an electric resistance of 0.05 ohms-$cm^2$. The cation-exchange membrane comprised a sheet of polytetrafluoroethylene bearing sulfonic acid group as the cation-exchange groups (available under a tradename "Nafion" 336 from du Pont Inc., U.S.A.).

Aqueous potassium chloride solution was electrolysed in the cell, with aqueous 25% potassium hydroxide solution being charged in the cathode compartment, and with aqueous solution containing 200 g/l of potassium chloride being charged in the anode compartment and then heated to 70° C.

After one hour operation of the electrolysis, the voltage was 3.4 volts between the opposite anode and cathode plates.

EXAMPLE 2 (Comparative)

The procedure of Example 1 was repeated except that the foraminate metal mesh of low hydrogen-overvoltage and the microporous film which were superposed on the cathode plate were removed out of the cell. After one hour operation, the voltage was 3.6 volts between the opposite anode and cathode plates. After the passage of electric current for one hour, the electric current was stopped. 10 Minutes later, the anolyte and catholyte were drained out well from the cell, and the cation-exchange membrane was checked to observe that the cathode-facing side of the cation-exchange membrane was contaminated with an appreciable quantity of corroded ferrous material.

EXAMPLE 3

Experiments for electrolysis of aqueous sodium chloride solution were conducted using a cell provided with vertical, mono-polar electrodes as shown in FIGS. 1–2, of which the cation-exchange membrane showed an effective membrane area of 23 $dm^2$. The experiments were made at a current density of 30 $A/dm^2$. The anode plate, the cathode plate and the foraminate metal mesh of low hydrogen-overvoltage installed in the cell were of the same kinds as those of the cell employed in Example 1, respectively, but the dimensions of them were different from those of the cell employed in Example 1. The microporous film used in this Example comprised a sheet of woven cloth of 0.5 mm thick and made of very fine polytetrafluoroethylene filaments (available under tradename "Polyflon Seal" from Daikin Co., Japan) which had been pre-treated with metallic sodium and ethyl alcohol to impart hydrophilic properties to the cloth. This microporous film exhibited an electric resistance of 0.11 ohms-$cm^2$. The cation-exchange membrane comprised a sheet of a polytetrafluoroethylene bearing sulfonic acid group as the cation-exchange groups (available under a tradename "Nafion" 215 from du Pont Inc., U.S.A.).

Electrolysis was effected with aqueous 28% sodium hydroxide solution circulating through the cathode compartment, and with a brine containing 300 g/l of sodium chloride being fed into the anode compartment at a decomposition rate of 50%. The effluent from the outlet of the cell was maintained at a temperature of 67°–73° C. by heating the catholyte by means of an electric heater and returning the heated catholyte back into the cell. After 3 days operation, the voltage was 3.6 volts between the anode and cathode plates and the current efficiency was 91%.

EXAMPLE 4 (Comparative)

The procedure of Example 3 was repeated except that the foraminate metal mesh and the microporous film which were superposed on the cathode plate were removed out of the cell. Already after 2 days operation, the voltage was 3.75 volts and the current efficiency was 90%.

What we claim is:

1. A cathode structure for use in an electrolytic cell of the vertical type for electrolysis of aqueous alkali metal chloride solutions, coprising a vertical cathode, a flexible and foraminate metal mesh of low hydrogen-over-voltage vertically and removably mounted on one side of said cathode, an essentially hydraulically permeable and hydrogen gas bubbles impenetrable, non-metallic microporous film vertically and removably mounted on said metal mesh and a cation exchange membrane vertically and removably mounted on said non-metallic microporous film, in such a way that the cathode, the metal mesh, the non-metallic microporous film and the cation exchange membrane can be pressed against each other and brought into close contact with each other by means of an expandable anode.

2. An electrolytic cell for use in the electrolysis of aqueous alkali metal chloride solutions and comprising one or more expandable anodes, one or more cathodes and one or more cation-exchange membranes each located between the opposite anode and cathode surfaces, characterized in that a flexible and foraminate metal mesh of low hydrogen-over-voltage is removably mounted on the anode-opposing surface of the cathode, a microporous film made of polypropylene, polytetrafluoroethylene, asbestos, polyvinyl chloride or a sintered mixture of finely divided graphite and polytetrafluoroethylene and which is essentially hydraulically permeable but through which hydrogen gas bubbles are essentially impenetrable, is removably mounted on said metal mesh, and a cation-exchange membrane is removable mounted on said microporous film, and that the expandable anode is so positioned adjacent to the cation-exchange membrane that the expandable anode is able to exert the force to bring the cation-exchange membrane, the microporous film, the metal mesh and the cathode surface into close contact with each other to form a unitary cathode structure.

3. A cell of claim 2 in which the foraminate metal mesh is merely superposed on the anode-opposing surface of the cathode.

4. A cell of claim 2 in which the forminate metal mesh is mechanically connected at some portions thereof to the cathode by means of fine wire.

5. A cell of claim 2 in which the microporous film contains micropores of 1 to 100 microns in diameter.

6. A cell of claim 2 in which the cation-exchange membrane is made of a polytetrafluoroethylene bearing sulfonic acid group as the cation-exchange group.

7. A cell of claim 2 in which the expandable anode is of the type that when it is contracted it exerts a resilient force outwardly.

8. A cathode structure for use in an electrolytic cell of vertical type for electrolysis of aqueous alkali metal chloride solutions, comprising a vertical cathode, a flexible and foraminate metal mesh of low hydrogen-over voltage vertically and removable mounted on one side of said cathode, an essentially hydraulically permeable and hydrogen gas bubbles impenetrable, microporous film made of polypropylene, polytetrafluoroethylene, asbestos, polyvinyl chloride or a sintered mixture of finely divided graphite and polytetrafluoroethylene vertically and removably mounted said metal mesh, and a cation-exchange membrane vertically removably mounted on said microporous film, in such a way that the cathode, the metal mesh, the microporous film and the cation-exchange membrane can be pressed against each other and brought into close contact with each other by means of an expandable anode.

* * * * *